US005938337A

United States Patent [19]

Provan et al.

[11] Patent Number: 5,938,337

[45] Date of Patent: Aug. 17, 1999

[54] BOTTOM FILLED, BOTTOM-GUSSETED BAG AND METHOD OF MAKING THE SAME

[75] Inventors: Alexander R. Provan, Canandaigua; Toby R. Thomas, Pittsford, both of N.Y.

[73] Assignee: Tenneco Packaging Inc., Lake Forest, Ill.

[21] Appl. No.: 09/170,273

[22] Filed: Oct. 13, 1998

[51] Int. Cl.[6] ..... B65D 30/20; B65D 33/24; B65D 33/34

[52] U.S. Cl. ..... 383/5; 53/455; 53/468; 53/469; 53/139.2; 383/64; 383/67; 383/120; 383/121

[58] Field of Search ..... 383/64, 67, 5, 383/120, 121, 202, 122, 63, 65; 53/139.2, 455, 468, 469

[56] References Cited

U.S. PATENT DOCUMENTS

| | | | |
|---|---|---|---|
| 2,506,311 | 5/1950 | Moore | 229/53 |
| 2,971,874 | 2/1961 | Canno | 154/83 |
| 3,070,278 | 12/1962 | Korn | 229/62 |
| 3,337,117 | 8/1967 | Lehmacher et al. | 383/120 |
| 3,456,867 | 7/1969 | Repko | 229/66 |
| 4,355,494 | 10/1982 | Tilman | 53/416 |
| 4,410,130 | 10/1983 | Herrington | 383/62 |
| 4,415,386 | 11/1983 | Ferrell et al. | 156/64 |
| 4,419,159 | 12/1983 | Herrington | 156/66 |
| 4,517,788 | 5/1985 | Scheffers | 53/459 |
| 4,519,095 | 5/1985 | Clayton | 383/86 |
| 4,524,459 | 6/1985 | Titchenal | 383/37 |
| 4,561,109 | 12/1985 | Herrington | 383/65 |
| 4,581,006 | 4/1986 | Hugues et al. | 493/213 |
| 4,582,549 | 4/1986 | Ferrell | 156/66 |
| 4,617,683 | 10/1986 | Christoff | 383/63 |
| 4,637,060 | 1/1987 | Ausnit | 383/63 |
| 4,651,504 | 3/1987 | Bentsen | 53/452 |
| 4,655,862 | 4/1987 | Christoff et al. | 156/66 |
| 4,663,915 | 5/1987 | Van Erden et al. | 53/450 |
| 4,666,536 | 5/1987 | Van Erden et al. | 156/64 |

(List continued on next page.)

OTHER PUBLICATIONS

Fig. 1 Drawing, A Method of Folding that Produces a Gusset Bottom in Thermoplastic Film, Tenneco Packaging, Inc., Lake Forest, IL, p. 2.

*Primary Examiner*—Stephen P. Garbe
*Attorney, Agent, or Firm*—Arnold, White & Durkee

[57] ABSTRACT

A bottom-fillable, bottom-gusseted bag including a bag-forming structure having first and second opposing body panels joined along a pair of opposing transverse seals and an offset bottom-gusset extending between the transverse seals. The bag-forming structure includes an open end opposite the offset gusset. The offset gusset includes first and second gusset panels foldably connected to each other and foldably connected to the respective first and second body panels. The second gusset panel extends beyond the first gusset panel to provide a protruding trim portion. A zipper is attached between the first and second body panels along the open end. A slider is slidably mounted to the zipper for opening and closing the zipper. A transverse slit is disposed proximate to a fold line foldably connecting the second gusset panel to the second body panel and provides a fill opening through which a product can be inserted into the bag-forming structure. This bottom-gusseted bag is easy to produce and is capable of being bottom-filled while accommodating the slider for easily opening and closing the bag.

35 Claims, 12 Drawing Sheets

U.S. PATENT DOCUMENTS

| | | | |
|---|---|---|---|
| 4,709,398 | 11/1987 | Ausnit | 383/63 |
| 4,709,533 | 12/1987 | Ausnit | 53/451 |
| 4,710,157 | 12/1987 | Posey | 493/213 |
| 4,736,450 | 4/1988 | Van Erden et al. | 383/65 |
| 4,790,126 | 12/1988 | Boeckmann | 53/451 |
| 4,812,074 | 3/1989 | Ausnit et al. | 493/213 |
| 4,840,012 | 6/1989 | Boeckmann | 53/410 |
| 4,844,759 | 7/1989 | Boeckmann | 156/66 |
| 4,876,842 | 10/1989 | Ausnit | 53/410 |
| 4,878,987 | 11/1989 | Ven Erden | 156/519 |
| 4,894,975 | 1/1990 | Ausnit | 53/412 |
| 4,909,017 | 3/1990 | McMahon et al. | 53/410 |
| 4,924,655 | 5/1990 | Posey | 53/128 |
| 4,941,307 | 7/1990 | Wojcik | 53/142 |
| 4,969,309 | 11/1990 | Schwarz et al. | 53/412 |
| 4,974,395 | 12/1990 | McMahon | 53/551 |
| 4,993,212 | 2/1991 | Veoukas | 53/451 |
| 5,014,498 | 5/1991 | McMahon | 53/451 |
| 5,027,584 | 7/1991 | McMahon et al. | 53/451 |
| 5,036,643 | 8/1991 | Bodolay | 53/128.1 |
| 5,042,224 | 8/1991 | McMahon | 53/133.4 |
| 5,046,300 | 9/1991 | Custer et al. | 53/412 |
| 5,072,571 | 12/1991 | Boeckmann | 53/133.4 |
| 5,085,031 | 2/1992 | McDonald | 53/412 |
| 5,092,831 | 3/1992 | James et al. | 493/394 |
| 5,105,603 | 4/1992 | Natterer | 53/412 |
| 5,111,643 | 5/1992 | Hobock | 53/551 |
| 5,127,208 | 7/1992 | Custer et al. | 53/412 |
| 5,179,816 | 1/1993 | Wojnicki | 53/133.4 |
| 5,247,781 | 9/1993 | Runge | 53/412 |
| 5,322,579 | 6/1994 | Van Erden | 156/66 |
| 5,383,989 | 1/1995 | McMahon | 156/66 |
| 5,400,565 | 3/1995 | Terminella et al. | 53/133.4 |
| 5,400,568 | 3/1995 | Kanemitsu et al. | 53/412 |
| 5,412,924 | 5/1995 | Ausnit | 53/412 |
| 5,417,040 | 5/1995 | Davoren | 53/455 |
| 5,425,216 | 6/1995 | Ausnit | 53/410 |
| 5,480,230 | 1/1996 | May | 383/61 |
| 5,505,037 | 4/1996 | Terminella et al. | 53/133.4 |
| 5,519,982 | 5/1996 | Herber et al. | 53/133.4 |
| 5,529,394 | 6/1996 | Davoren | 383/61 |
| 5,551,208 | 9/1996 | Van Erden | 53/139.2 |
| 5,557,907 | 9/1996 | Malin et al. | 53/139.2 |
| 5,561,966 | 10/1996 | English | 53/412 |
| 5,564,259 | 10/1996 | Stolmeier | 53/410 |
| 5,592,802 | 1/1997 | Malin et al. | 53/133.4 |
| 5,669,715 | 9/1997 | Dobreski et al. | 383/5 |
| 5,682,730 | 11/1997 | Dobreski | 53/469 |
| 5,713,669 | 2/1998 | Thomas et al. | 383/204 |
| 5,775,812 | 7/1998 | Phillips et al. | 383/5 |
| 5,788,378 | 8/1998 | Thomas | 383/63 |
| 5,826,401 | 10/1998 | Bois | 53/412 |

A
B
C
D
E
5
8
9
10
19
20
22
24
26
28
30
32
33
34
35
36
41
50
52
60
62

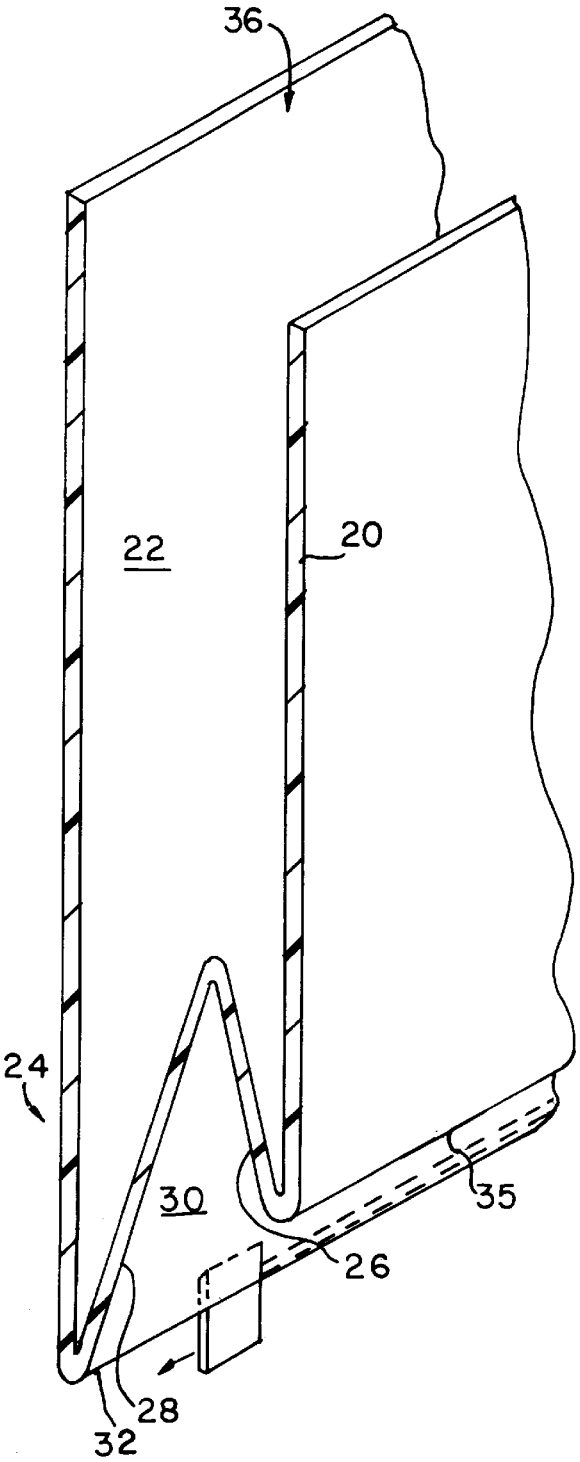
FIG. 5A
FIG. 5C
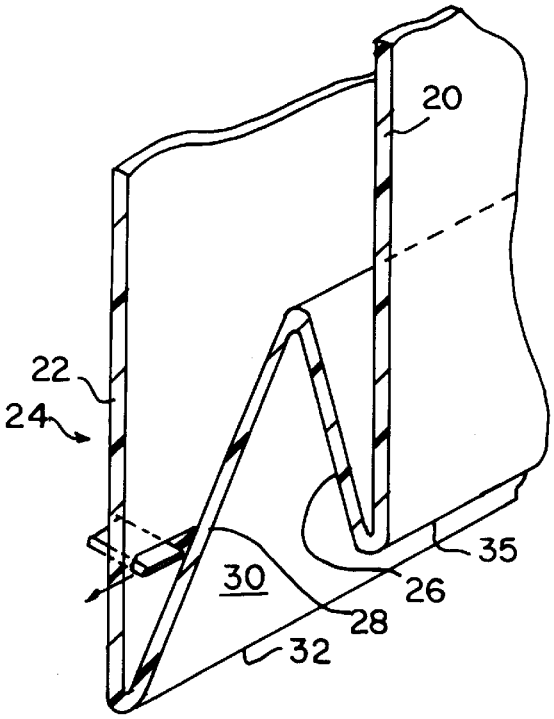
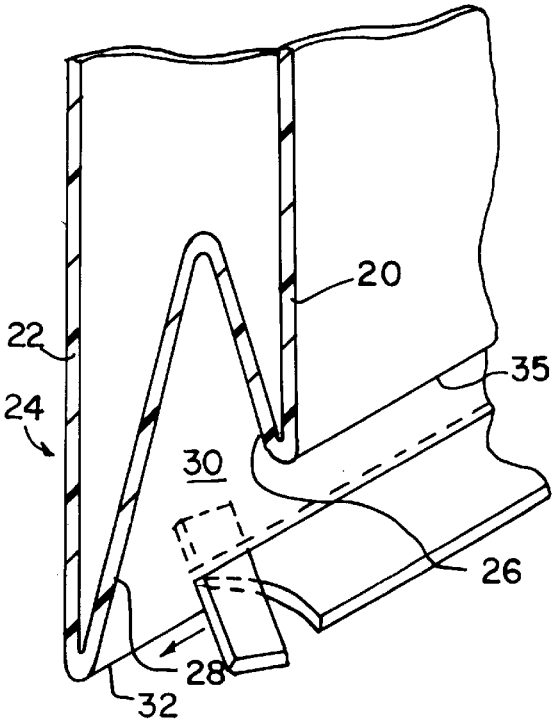
FIG. 5B

BOTTOM FILLED, BOTTOM-GUSSETED BAG AND METHOD OF MAKING THE SAME

FIELD OF THE INVENTION

The present invention relates generally to reclosable bags and, more particularly, to a bottom-fillable, bottom-gusseted reclosable bag.

BACKGROUND OF THE INVENTION

Reclosable bags are very common, especially in the food industry. Such bags are typically made to be reclosable via the use of a reclosable feature such as a reclosable zipper along the mouth end of the bags. Such zippers can be opened and closed either by digital pressure or by the use of a slider mounted to the zipper.

A bottom-gusseted bag has the advantages that the bag can accommodate a greater volume of product than non-gusseted bags and will stand upright when it is filled. Gusseted bags, however, are more difficult to produce. For example, one method to form a bottom-gusset requires a folding board and a tucking board. Then, a sheet of thermoplastic film is pulled by rollers over the folding board and the tucking board is used to fold the film about a tip of the tucking board. These steps require designing a complicated manufacturing process.

Reclosable bags are a great convenience to users. However, previous reclosable bags could generally be easily tampered with prior to purchase by the user. Consequently, tamper evident features were added to the mouth end of such bags so that a user would know if the bags were tampered with prior to their being used by the user. However, bottom-gusseted bags with reclosable, tamper evident tops are especially difficult to produce. For example, a previous method of forming a bottom-gusseted tamper evident bag requires enclosing the reclosable mouth of the bag in a pocket. This pocket provides the bag with a tamper evident feature, i.e., the reclosable bag top can not be opened without puncturing the pocket or tearing a removable strip on the pocket. Forming a bottom-gusseted bag with a tamper evident pocket, however, requires additional steps that further complicate the manufacturing process.

In order to provide a tamper evident feature, reclosable bags must be filled without destroying the tamper evident feature of the bag. Therefore, bottom-filled, tamper evident reclosable bags were devised. An example of such a bag is proposed in U.S. Pat. Nos. 5,417,040 and 5,529,394. These prior bottom-filled, tamper evident reclosable bags use a top pocket to enclose the zippered mouth of the bag. This top pocket presents a problem, however, if it is desirable to provide a slider to facilitate opening and closing the bag. Specifically, the top pocket prevents a slider from being easily installed on the zipper of prior bottom-filled, tamper evident reclosable bags.

A need therefore exists for a bottom-filled, bottom-gusseted bag that is easy to manufacture and can accommodate a slider for easily opening and closing the bag.

SUMMARY OF THE INVENTION

In one embodiment, a bottom-fillable, bottom-gusseted bag includes a bag-forming structure having first and second opposing body panels joined along a pair of opposing transverse seals and an offset bottom-gusset extending between the transverse seals. The bag-forming structure includes an open end opposite the offset gusset. The offset gusset includes first and second gusset panels foldably connected to each other and foldably connected to the respective first and second body panels. The second gusset panel extends beyond the first gusset panel to provide a protruding trim portion. A zipper is attached between the first and second body panels along the open end. A slider is slidably mounted to the zipper for opening and closing the zipper. A transverse slit is disposed proximate to a fold line foldably connecting the second gusset panel to the second body panel and provides a fill opening through which a product can be inserted into the bag-forrning structure. This bottom-gusseted bag is easy to produce and is capable of being bottom-filled while accommodating the slider for easily opening and closing the bag.

BRIEF DESCRIPTION OF THE DRAWINGS

FIG. 5A is a perspective cross-sectional view of the bag-forming structure of FIG. 2C with the offset bottom-gusset being slit along a fold line;

FIG. 5B is a partial perspective cross-sectional view of the bag-forming structure of FIG. 5A with the offset bottom-gusset being slit adjacent the fold line;

FIG. 5C is a perspective cross-sectional view of the bag-forming structure of FIG. 5A with the offset bottom-gusset being slit at another location adjacent the fold line;

DESCRIPTION OF ILLUSTRATIVE EMBODIMENTS

Figure 1:
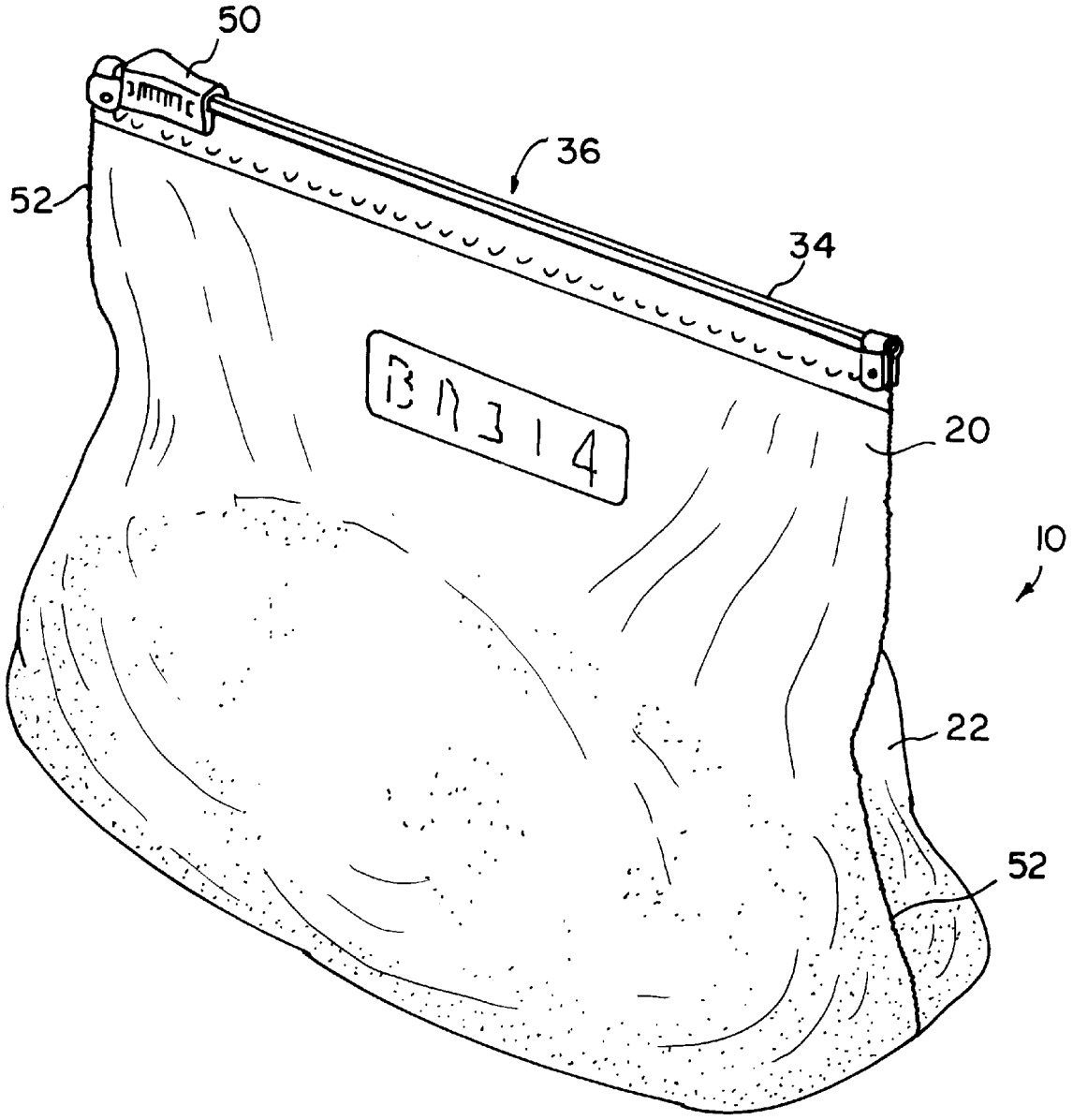
FIG. 1 is a perspective view of a bottom-filled, bottom-gusseted bag embodying the present invention, showing the bag in sealed form and partially filled.

A bottom-fillable, bottom-gusseted bag 10 is illustrated in FIG. 1. The bag 10, as illustrated in FIG. 1, is partially full. The bottom-gusset allows the bag 10 to stand upright when it is filled. The bag 10 includes first and second opposing body panels 20 and 22 joined along a pair of opposing transverse seals 52 and a bottom-gusset 24 extending between the transverse seals 52. The bag further includes a reclosable zipper 34 opposite the bottom-gusset 24. The zipper 34 is attached between the first and second body panels 20 and 22 along the bag mouth end 36. A slider 50 is slidably mounted to the zipper 34 for easily opening and closing the zipper 34.

Figures 2A, 2B, 2C:
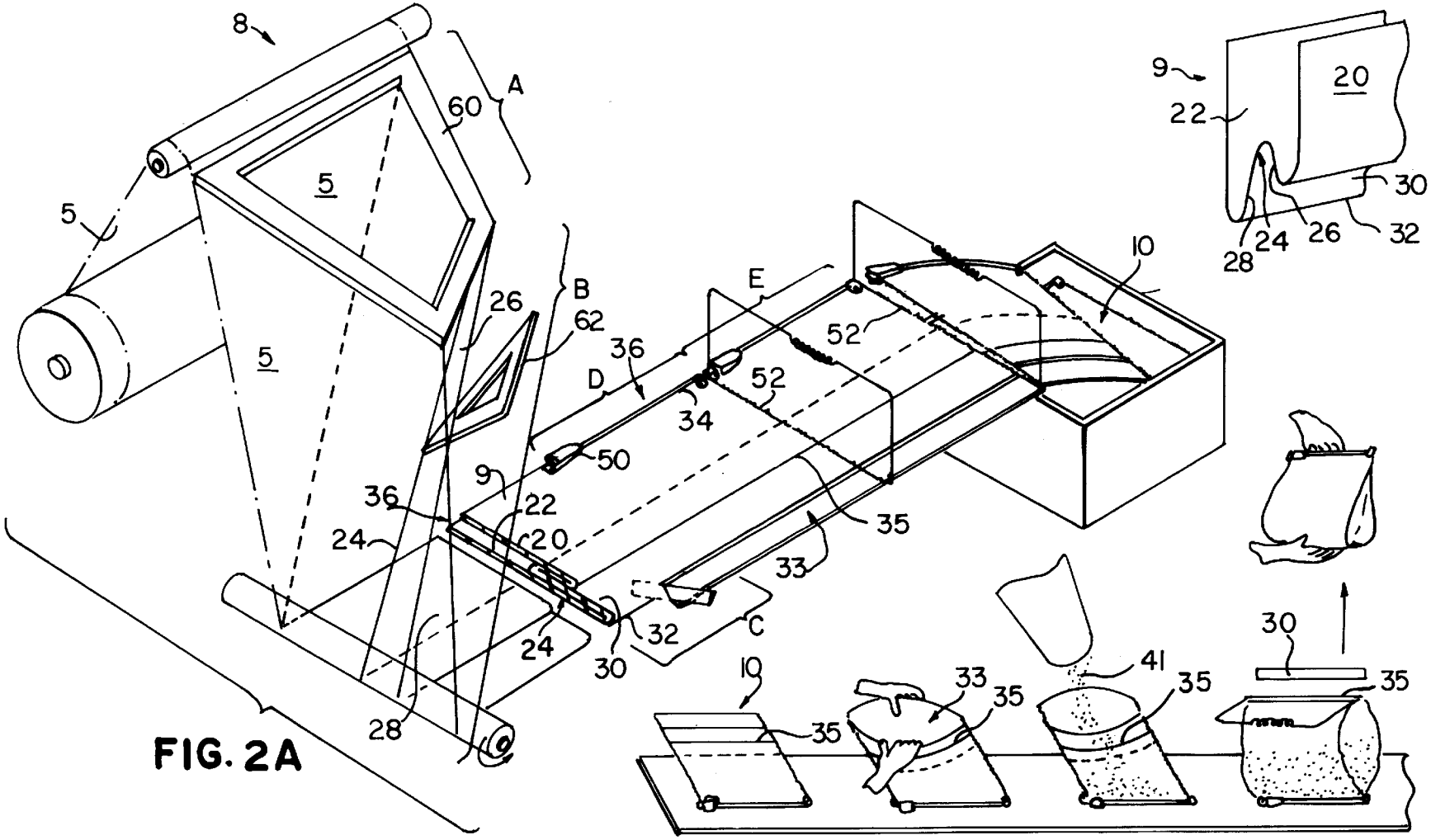
FIG. 2A is a perspective view of a method of making the bag of FIG. 1.
FIG. 2B is a perspective view showing a continuation of the method of FIG. 2A.
FIG. 2C is a perspective view of the bag-forming structure formed by the method of FIG. 2A.

Referring now to FIG. 2A, there is shown a method of making the bag 10 illustrated in FIG. 1. The bag 10 is formed from a sheet of material 5 which is provided in a longitudinal direction 8 in step A. The sheet of material 5 may, for example, comprise, alone or in combination, one or more of the following materials: foil, paper, a thermoplastic film, a laminate, a paper-poly laminate, a foil-poly laminate, etc. The sheet 5 is folded in step B to form a bag-forming structure 9 which includes first and second opposing body panels 20 and 22 and an offset bottom-gusset 24 that joins the first and second body panels 20 and 22, as illustrated in FIG. 2C. The offset bottom-gusset 24 includes first and second gusset panels 26 and 28 which are foldably connected to each other and foldably connected to the first and second body panels 20 and 22, respectively. The second gusset panel 28 extends beyond the first gusset panel 26 to provide a protruding trim portion 30. A fold line 32 is disposed between the trim portion 30 and the second body panel 22.

Figure 3A:
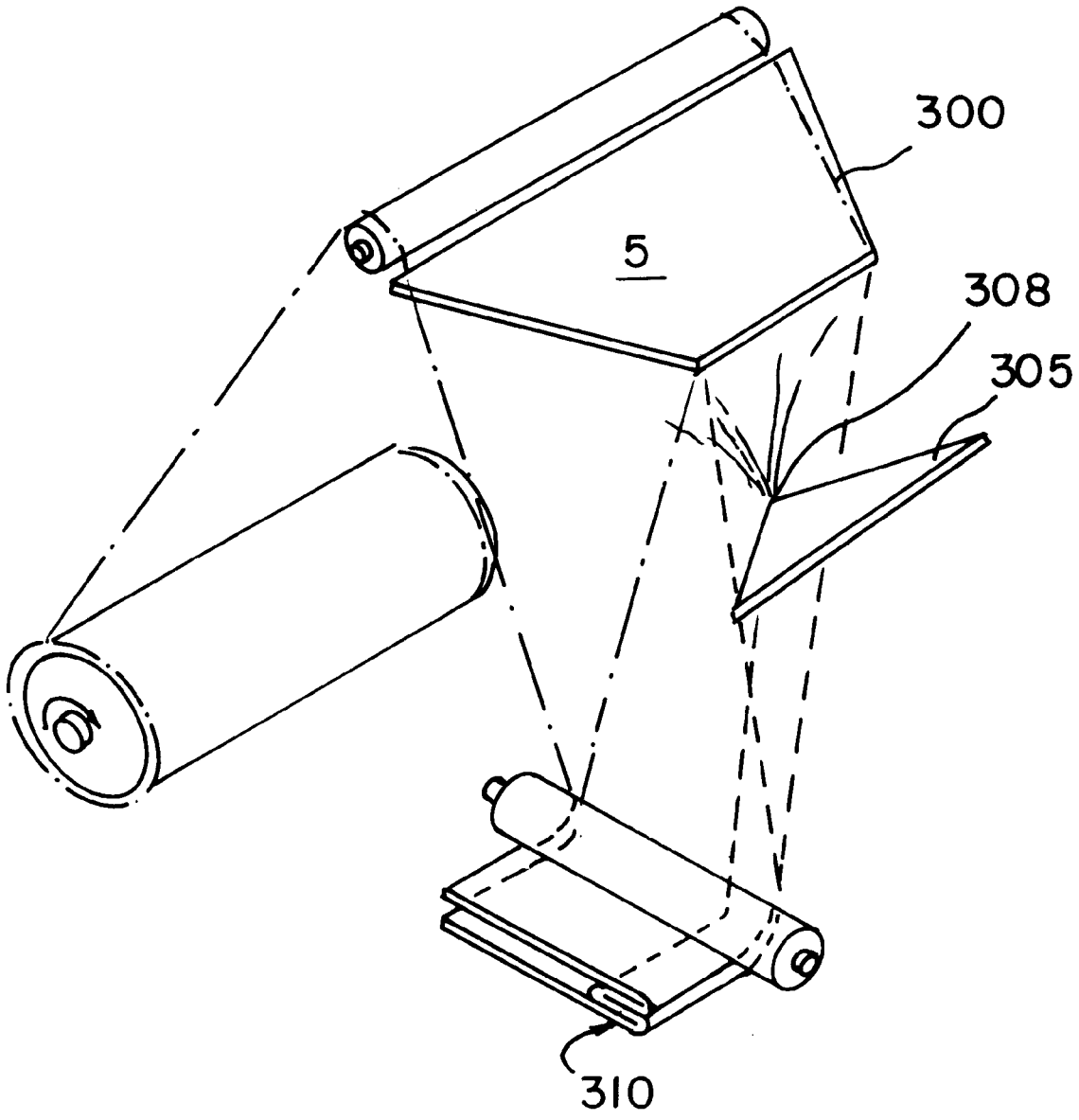
FIG. 3A (PRIOR ART)
FIG. 3A is a perspective view of a prior art method of making a standard bottom-gusset for a bag.
Figure 3B:
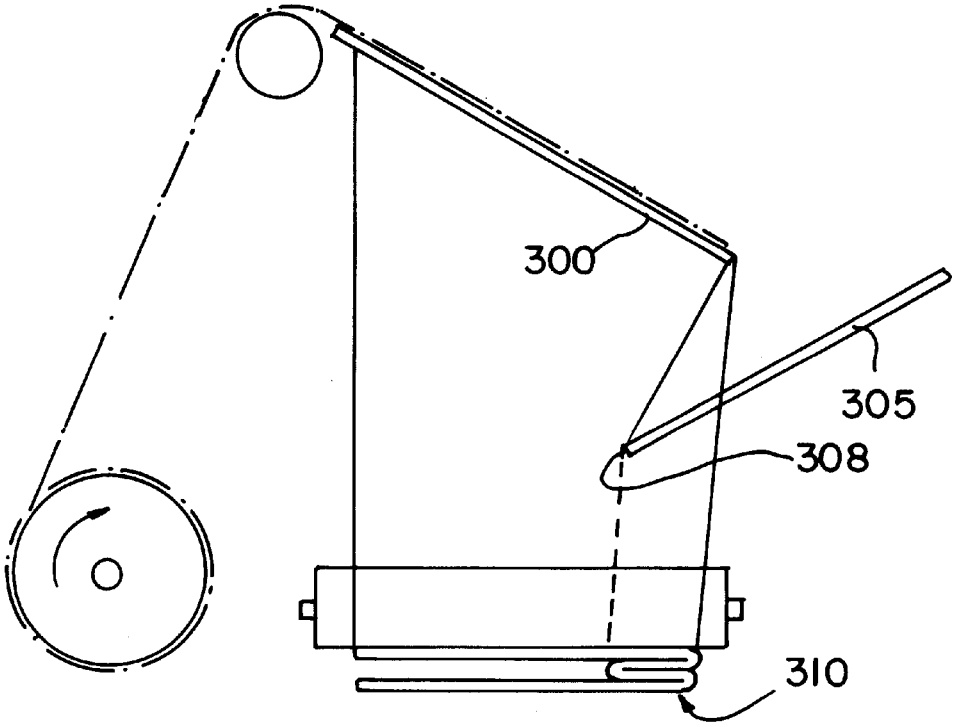
FIG. 3B (PRIOR ART)
FIG. 3B is a side view of the prior art method depicted in FIG. 3A.
Figure 3C:
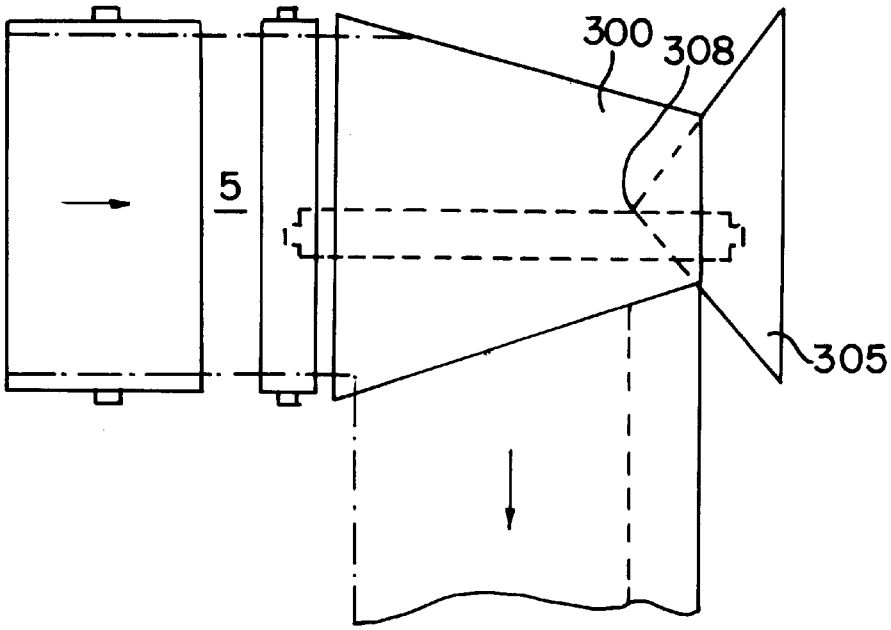
FIG. 3C (PRIOR ART)
FIG. 3C is a top view of the prior art method depicted in FIG. 3A.

The sheet 5 is folded by using a folding board. One prior method of forming a standard bottom-gusset uses a typical folding board similar to the one illustrated in FIGS. 3A–3C. This typical folding board 300 is shaped like a bi-laterally symmetrical trapezoid. This prior method of making a standard bottom-gusseted bag also requires a tucking board. A typical tucking board used in this prior method is illustrated in FIGS. 3A–C. This typical tucking board 305 is shaped like an isosceles triangle that is displaced slightly below the shorter parallel side of the trapezoidal folding board 300. The standard bottom-gusset 310 is formed by pulling the sheet 5 over the folding board 300 and folding the sheet 5 about the tip 308 of the tucking board 305.

Figure 4A:
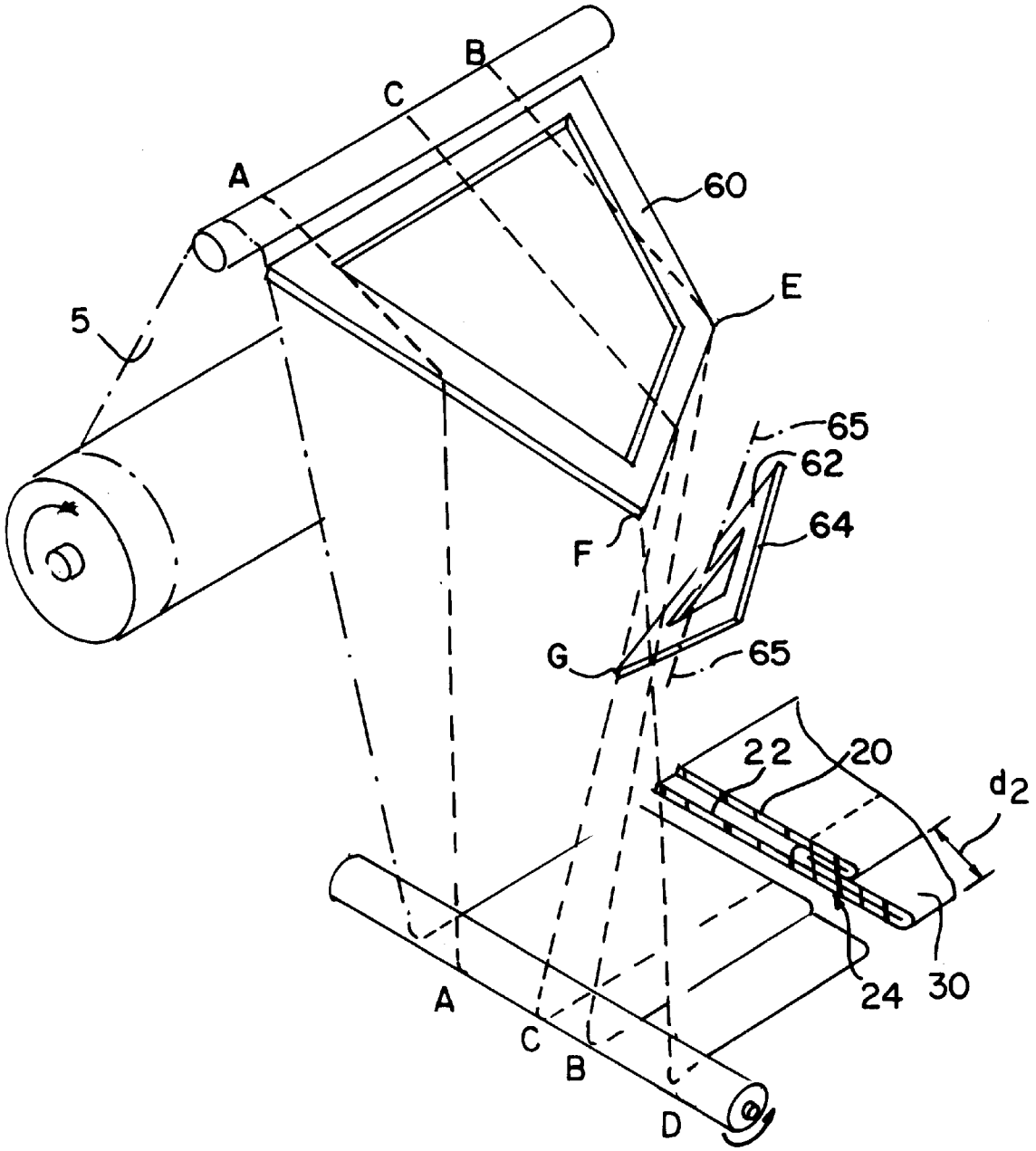
FIG. 4A is a perspective view of the method of FIGS. 2A–B, according to the present invention, of making an offset gusset.
Figure 4B:
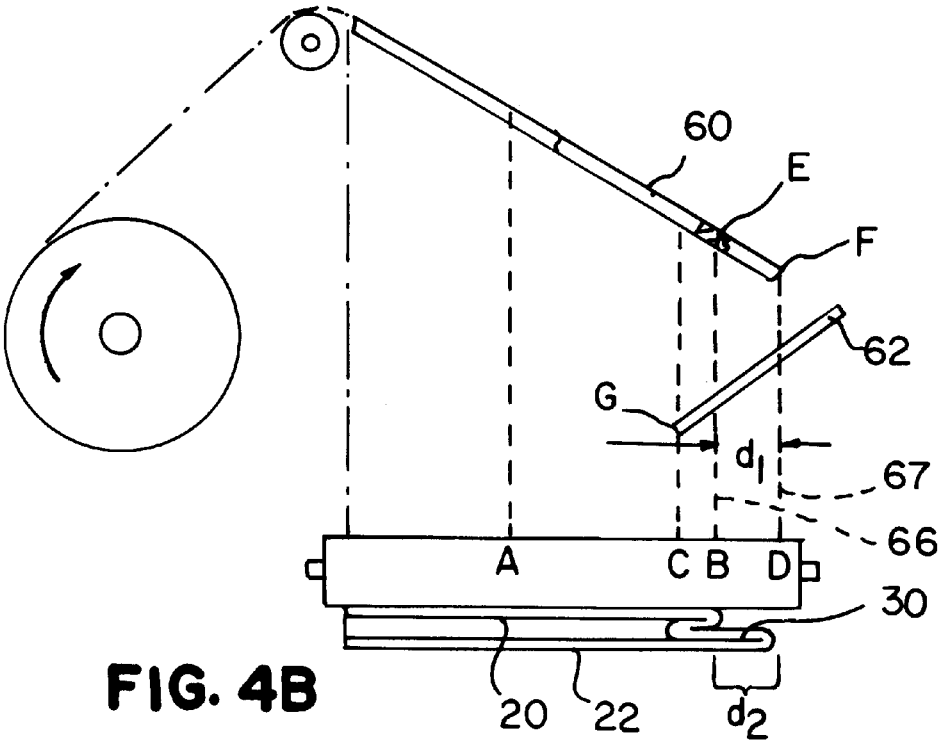
FIG. 4B is a side view of the method in FIG. 4A.
Figure 4C:
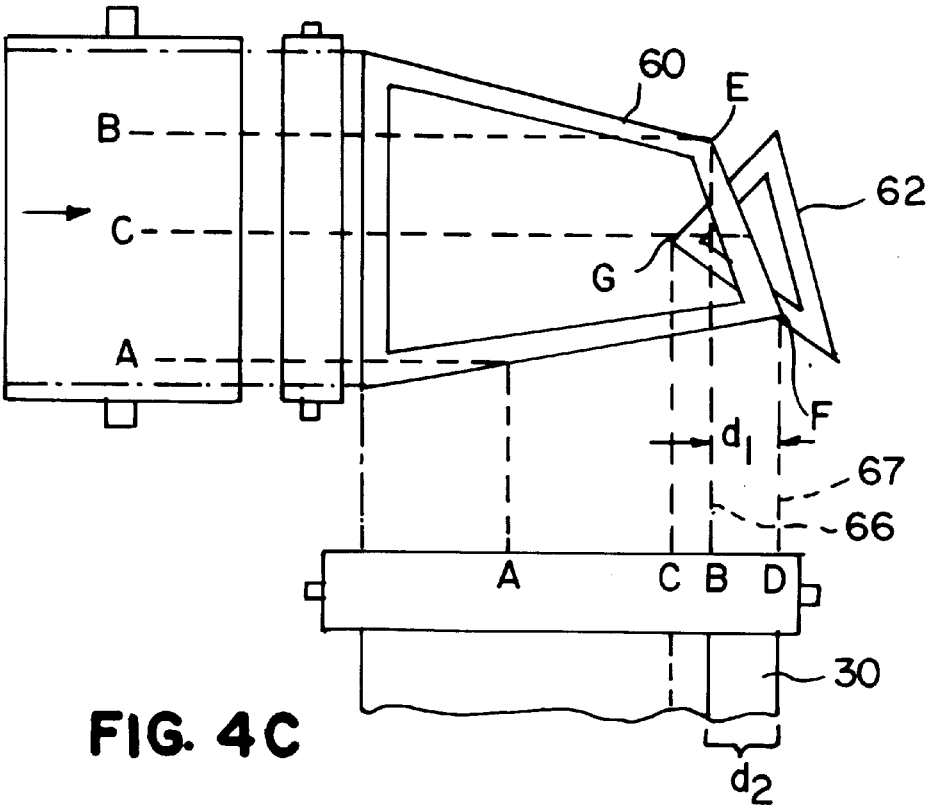
FIG. 4C is a top view of the method in FIG. 4A.

In the inventive process, a different folding board 60 is used to create the offset bottom-gusset 24 and the aligned open mouth end 36 illustrated in FIG. 5A. The folding board 60 used to make the offset bottom-gusset 24 of the present invention is best depicted in FIGS. 4A–C. The illustrated folding board 60 is not a bi-laterally symmetrical trapezoid. Rather, the line EF is skewed so as to form an offset bottom-gusset 24 while maintaining equal path lengths A—A, B—B and C—C along the length of the sheet of sheet 5 that is fed over the folding board 60. If the path lengths are unequal, the sheet will either stretch or bunch, both of which are not desirable. A tucking board 62 is used to form the offset bottom-gusset fold 24 by tucking a portion of the sheet 5 inward between the points E and F. The tucking board 62 is shaped like a triangle. The base 64 of the triangle is parallel to the line EF. The triangular tucking board 62 is in a plane intersecting a line 65 parallel to line EF. In the illustrated embodiment, the folding board 60 is vertically displaced above the tucking board 62 at line EF by a distance approximately equal to the thickness of the sheet of material 5 (FIGS. 4A–C exaggerate this distance to better illustrate the path of the sheet 5). The tucking board pivots about the line 65 such that the sheet 5 is taut about the tip G of the triangle. As long as the relationship between the folding board 60 and the tucking board 62 is maintained as described above, the illustrated embodiment of FIGS. 4A–C may be rotated such that the sheet 5 travels, for example, in a horizontal plane, or any other plane, between the tucking board 60 and the folding board 62.

The skew of line EF may be determined by a trial and error method. The key to designing the folding board is to produce a folding board geometry that maintains the path lengths A—A, B—B and C—C constantly equal along the length of the sheet 5. Again, if the path lengths become unequal due to the geometry of the folding board, the sheet 5 will either stretch or bunch which is not desirable. From the top view perspective of FIG. 4C, the projected distance d, between two vertical, parallel lines 66 and 67 that intersect points E and F is equal to the horizontal distance $d_2$ between points B and D. The horizontal distance $d_2$ is the horizontal distance between the two vertical, parallel lines 66 and 67 that intersect points E and F when those points are projected on to a horizontal surface disposed below the folding board 60. Thus, the horizontal distance $d_2$ is equal to the length of the trim portion 30. The above described geometry of the folding board 60 produces the offset bottom-gusset 24.

Figure 6:
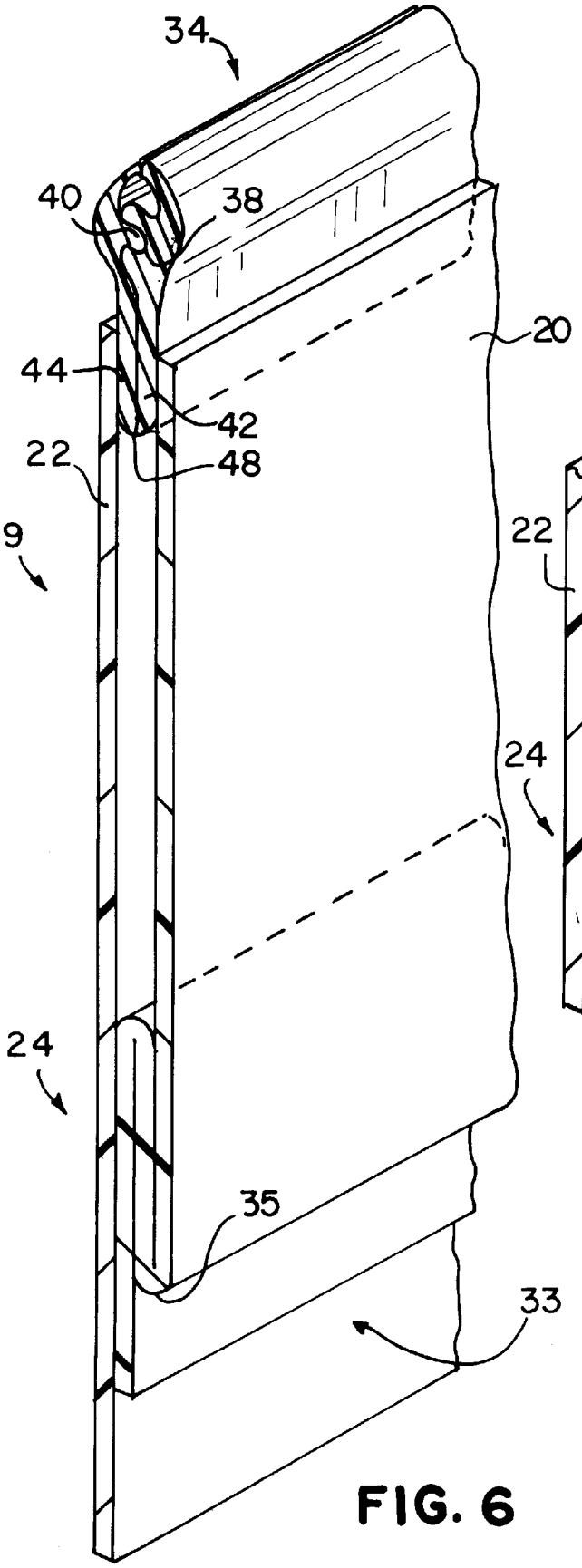
FIG. 6 is a perspective cross-sectional view of the bag-forming structure after the offset bottom-gusset is slit.
Figure 7:
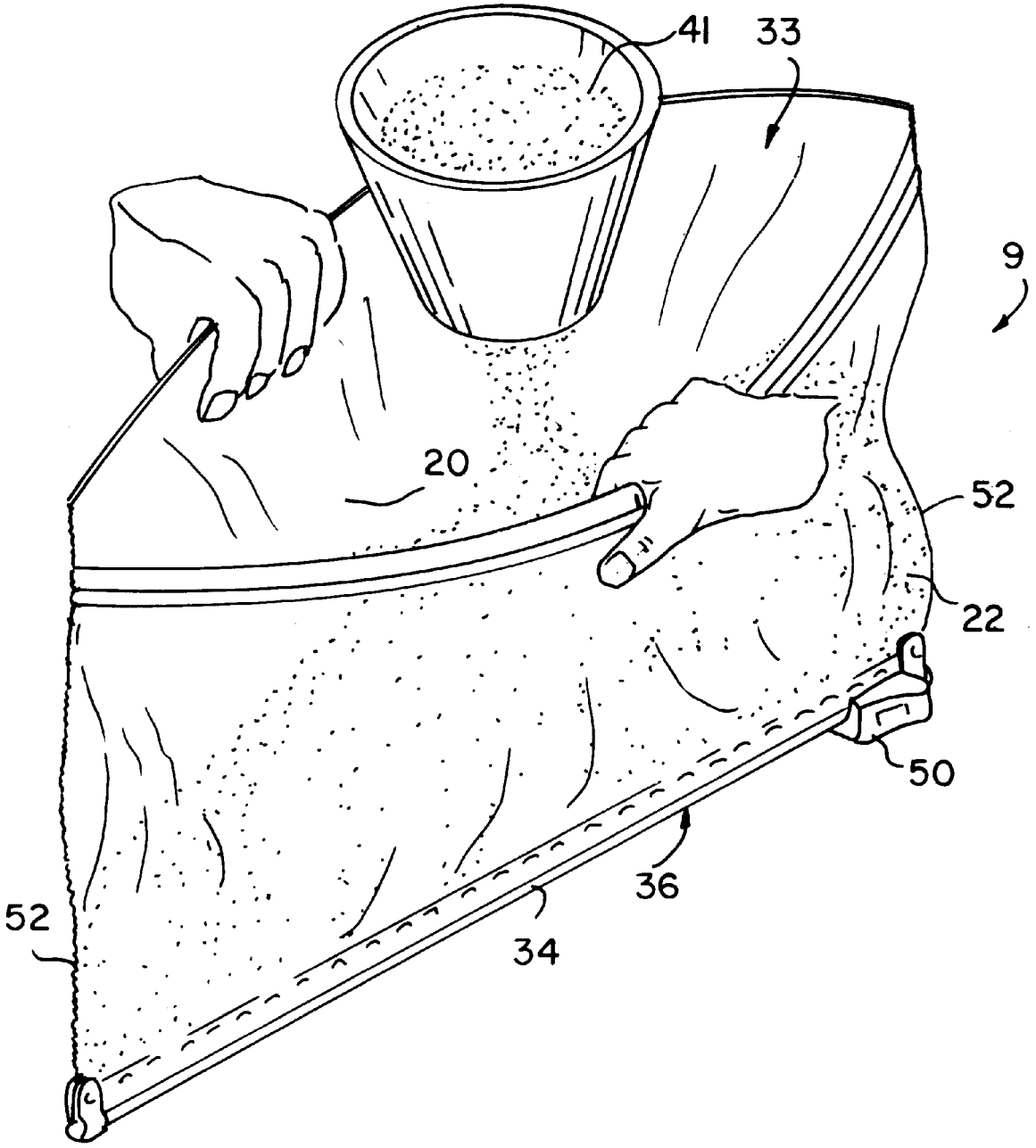
FIG. 7 is a perspective view of the bag-forming structure in which the slit gusset is open for bottom-filling.

Returning to FIGS. 2A, the trim portion 30 is slit adjacent the fold line 32 at step C. The trim portion 30 may be slit along the fold line 32, as illustrated in FIG. 5A. Alternatively, the trim portion 30 may be slit above the fold line 32, as illustrated in FIG. 5B. The slit may also be located above the fold line 32 on the second body panel 22, as illustrated in FIG. 5C. Wherever the slit is located, the slit provides a transverse fill opening 33 through which a product 41 can be inserted into the bag-forming structure 9, as illustrated in FIGS. 2A–B and 7. FIG. 6 illustrates how the offset bottom-gusset 24 looks after it has been slit according to FIG. 5B.

Figure 10:
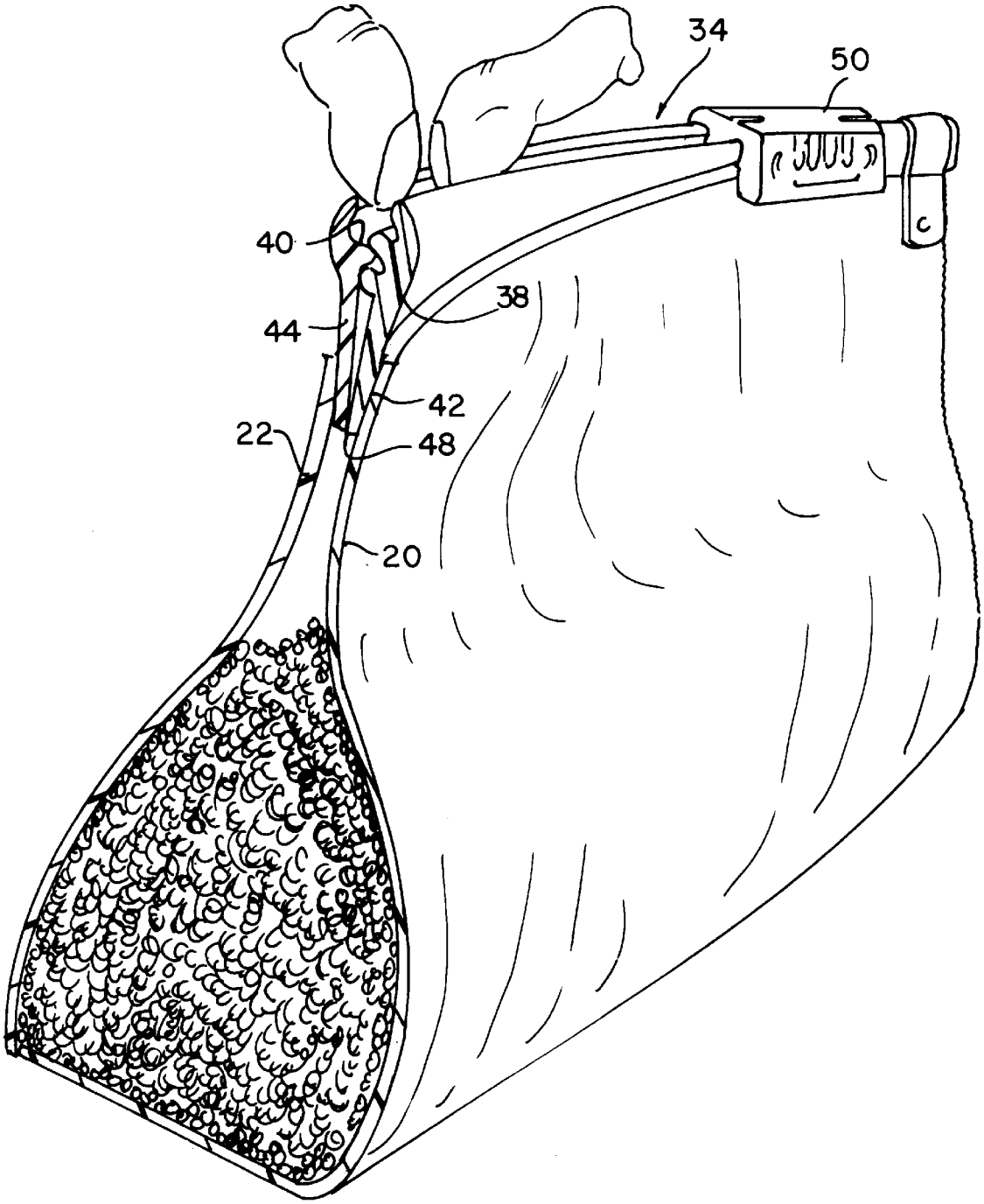
FIG. 10 is a perspective cross-sectional view of the bag in which the reclosable mouth is being opened after the bag has been bottom-filled and sealed.

Returning to FIG. 2A, a zipper 34 is applied, in step D, between the first and second body panels 20 and 22 along an open mouth end 36 of the bag-forming structure 9. The open mouth end 36 is opposite the offset bottom-gusset 24. As best illustrated in FIG. 10, the zipper 34 includes male and female tracks. The male track includes a male profile 40 and a first depending fin 44 extending downward from the male profile 40. Likewise, the female track includes a female profile 38 and a second depending fin 42 extending downward from the female profile 38. As illustrated in FIG. 10, the male and female profiles 40 and 38 are releasably engageable to each other, as described below.

To minimize tampering with the bag 10, the first and second fins 44 and 42 are detachably joined to each other to provide a tamper evident seal below the zipper 34, best illustrated in FIG. 10. Having the tamper evident seal below the zipper 34 allows the zipper to accommodate the slider 50, as described below. The first and second fins 42 and 44 may be attached to the respective first and second panels 20 and 22 by several methods. If the zipper 34 is formed separately from the body panels 20 and 22 of the bag 10, the first and second fins 42 and 44 are attached to inner surfaces of the respective first and second body panels 20 and 22 by, for example, thermal fusion or adhesive. Alternatively, where the panels 20 and 22 are comprised of a thermoplastic material, the zipper 34 may be extruded with the panels 20 and 22 such that the first fin 42 is integrally formed with the first body panel 20 and the second fin 44 is integrally formed with the second body panel 22. The tamper evident seal is formed by joining the lower edges of the first and second fins 42 and 44 to each other so that even if the zipper 34 were opened, the contents of bag 10 would be protected. The lower edges of the respective first and second fins 42 and 44 may be joined to each other either by, for example, thermal fusion or by integrally forming these lower edges with each other. Where the lower edges are integrally formed with each other, the first and second fins 42 and 44 are created from a single piece of thermoplastic material.

To permit a consumer to gain access to the interior of the bag 10 when the interior of the bag 10 is sealed for tamper-evident purposes, the joined fins 42 and 44 are preferably provided with a one-time breakable line of weakness 48, illustrated in FIG. 10. The line of weakness 48 may be formed by perforations, a score line, a die line, or the like. If the consumer purchases a prepackaged bag with the one-time breakable seal intact, it is highly unlikely that the contents of the bag have been tampered with because the bag 10 cannot easily be opened without breaking the seal. If, on the other hand, the consumer purchases a bag 10 with the one-time breakable seal broken, then it is more likely that the contents of the bag 10 have been tampered with.

In the embodiment illustrated in FIG. 2A, the bag 10 includes the zipper 34 which can accommodate the slider 50. The slider 50 can be slidably mounted to the zipper 34 for easily opening and closing the bag 10. After the slider 50 is slidably mounted on the zipper 34, the slider 50 is slidably movable between a closed position and an open position. In the closed position, the male and female profiles 40 and 38 of the zipper 34 are interlocked with each other, as illustrated in FIG. 6. As illustrated in FIG. 10, movement of the slider 50 from the closed position toward the open position disengages the male and female profiles 40 and 38 from each other and allows a user to gain access to the interior of the bag 10 (unless of course a tamper evident feature is in place). Further details concerning the construction and operation of the zipper 34 and the slider 50 may be obtained from U.S. Pat. No. 5,067,208 to Herrington, Jr. et al., which is incorporated herein by reference in its entirety.

Figure 8:
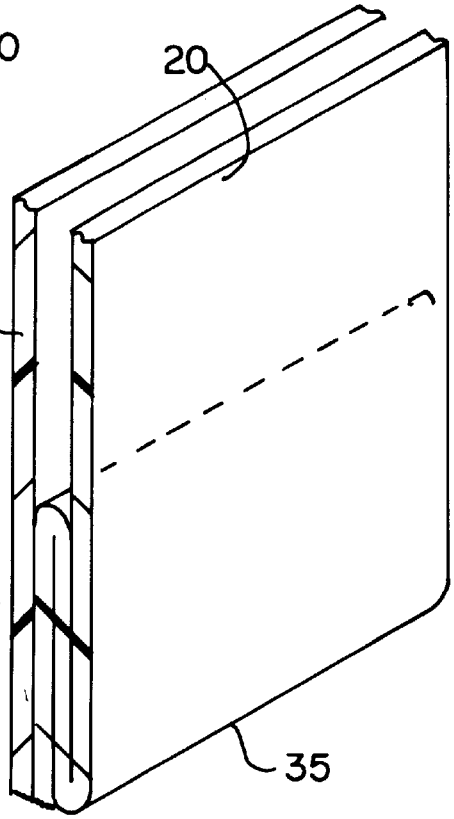
FIG. 8 is a perspective cross-sectional view of the bag-forming structure after the offset bottom-gusset has been cut and sealed.
Figure 9:
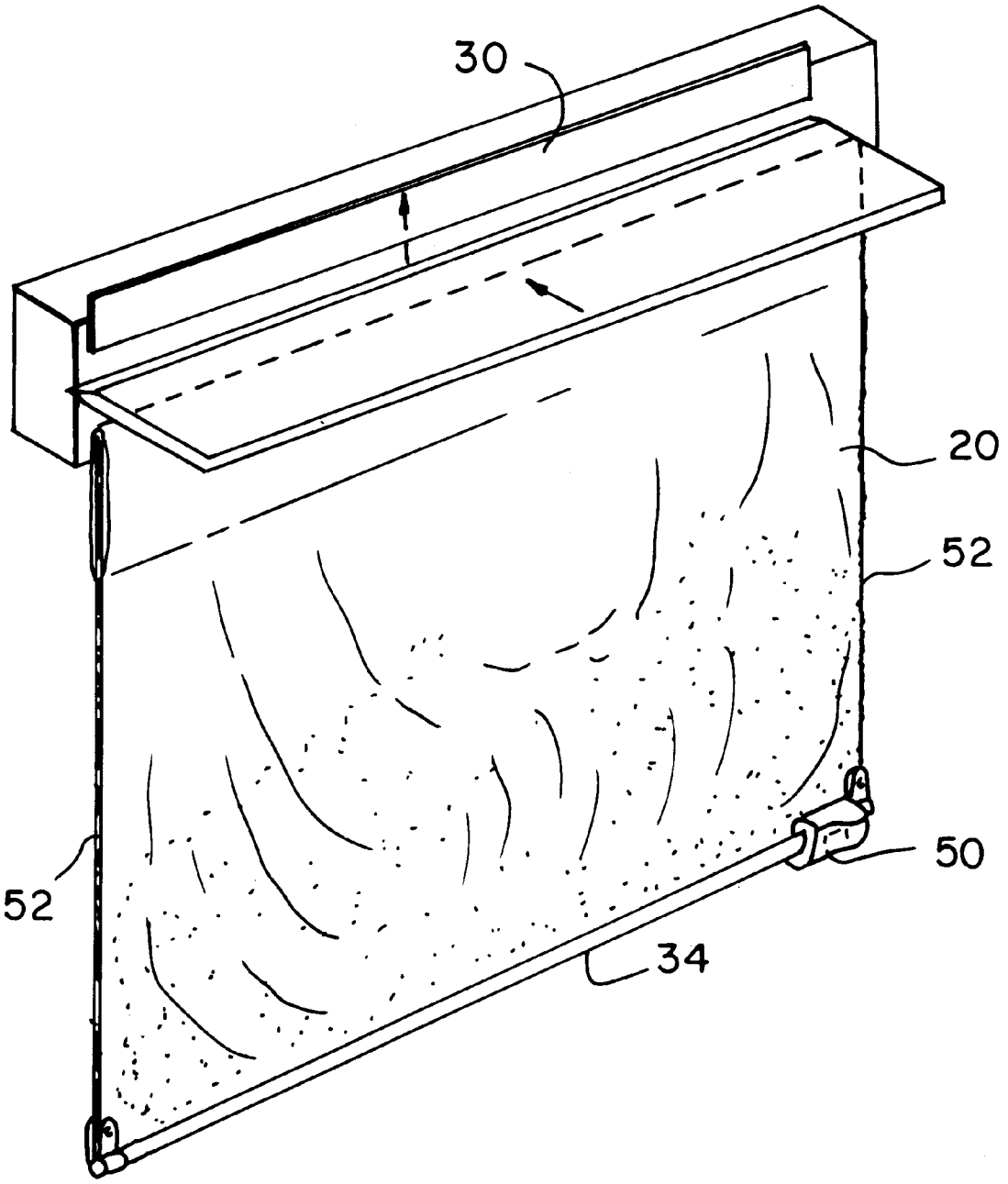
FIG. 9 is a perspective view of the bottom of the bag being cut and sealed.

The process illustrated in FIG. 2A proceeds in step E by applying a pair of transverse seals 52 to the bag-forming structure 9 to form one individual bag 10. The bag 10 is then stacked for shipment to a customer such as a food packager. The customer unpacks the stacked bags 10 and opens the bag fill opening 33, as illustrated in FIG. 2B. The customer then fills the bag 10 with a product 41, such as cereal, flour, oats, etc. After the bag 10 is filled through the fill opening 33, the fill opening 33 is closed by sealing the slit trim portion 30 adjacent to a fold line 35. Specifically, the fill opening 33 is closed by, for example, cutting away the trim portion 30 and simultaneously attaching a remaining portion of the second gusset panel 28 to the second body panel 22 to seal the fill opening 33, as illustrated in FIGS. 2B, 8 and 9. The resulting bag 10 has a sealed bottom-gusset 24 and a reclosable mouth end 36 with a tamper evident feature.

Figure 12:
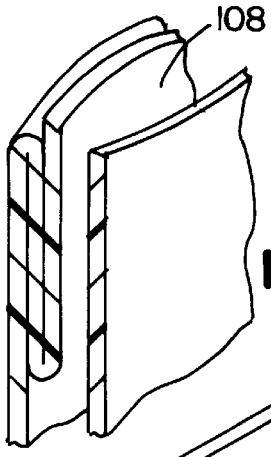
FIG. 12 is a perspective cross-sectional view of the bag-forming structure in which the slit gusset is open for bottom-filling.
Figure 13:
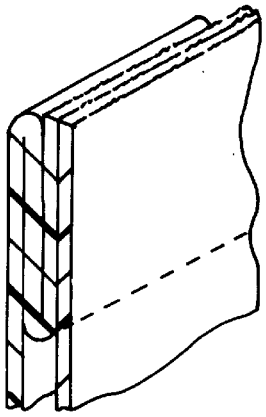
FIG. 13 is a perspective cross-sectional view of the bag-forming structure after the slit bottom-gusset has been sealed.
Figure 11:
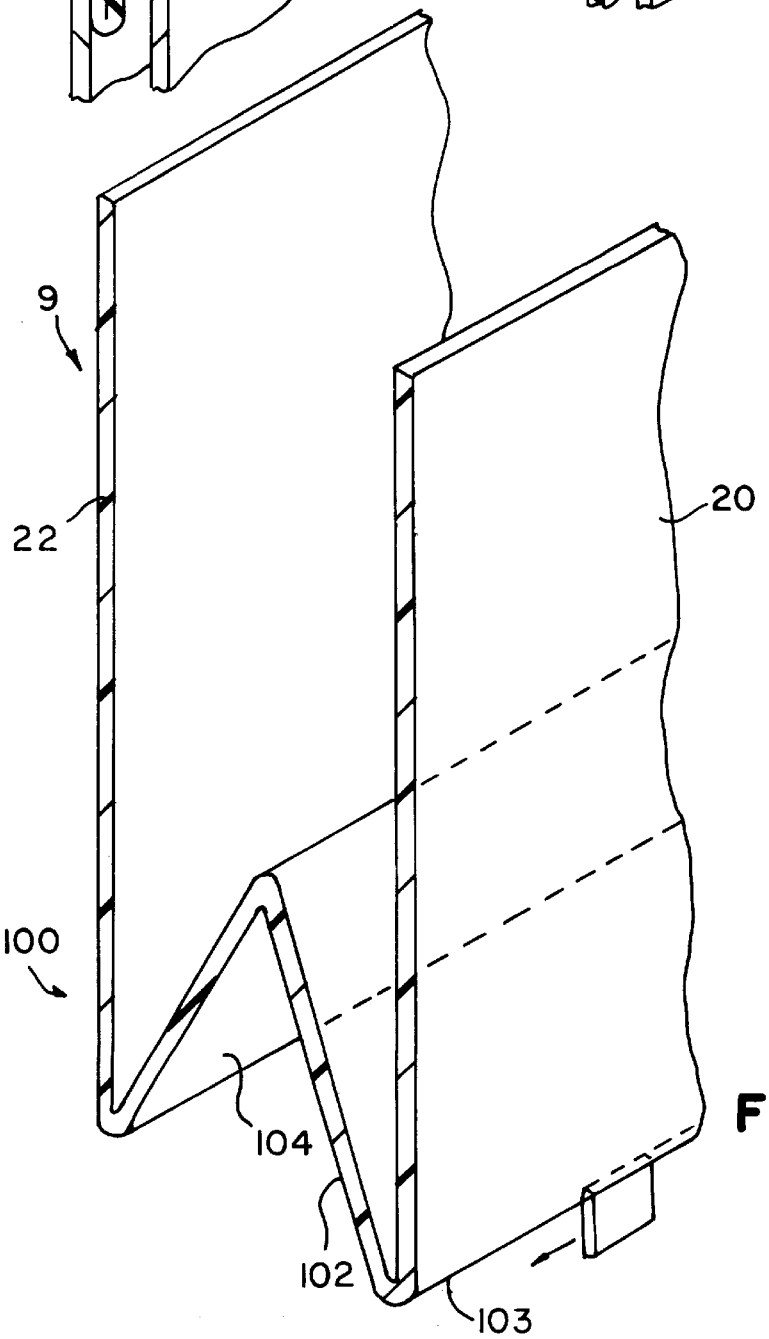
FIG. 11 is a perspective cross-sectional view of another embodiment of the present invention in which a bottom-gusset is being slit along a fold line.

In another embodiment, illustrated in FIGS. 11–13, the bag-forming structure 9 includes first and second opposing body panels 20 and 22 and a standard bottom-gusset 100 joining the first and second body panels 20 and 22. The bottom-gusset 100 includes first and second gusset panels 102 and 104 foldably connected to each other and foldably connected to the first and second body panels 20 and 22, respectively.

The bottom-gusset 100 is slit along a fold line 103 to provide a transverse fill opening 108 through which a product can be inserted into the bag-forming structure 9. A pair of transverse seals (not shown) are applied to the bag-forming structure 9 to form one individual bag.

While the present invention has been described with reference to one or more preferred embodiments, those skilled in the art will recognize that many changes may be made thereto without departing from the spirit and scope of the present invention which is set forth in the following claims.

What is claimed is:

1. A bottom-fillable, bottom-gusseted bag comprising:

a bag-forming structure including first and second opposing body panels joined along a pair of opposing transverse seals and an offset bottom-gusset extending between said transverse seals, said bag-forming structure including an open end opposite said offset gusset, said offset gusset including first and second gusset panels foldably connected to each other and foldably connected to said respective first and second body panels, said second gusset panel extending beyond said first gusset panel to provide a protruding trim portion;

a zipper attached to said first and second body panels along said open end; and a slider slidably mounted to said zipper for opening and closing said zipper.

2. The bag of claim 1, wherein said zipper includes first and second tracks, said first track including a first profile and a first fin extending downward from said first profile, said second track including a second profile and a second fin extending downward from said second profile, said first and second profiles being releasably engageable to each other.

3. The bag of claim 2, wherein said first and second fins are detachably connected to each other.

4. The bag of claim 1, further comprising a transverse slit disposed proximate to a fold line foldably connecting said trim portion to said second body panel to provide a fill opening through which a product can be inserted into said bag-forming structure.

5. The bag of claim 4, wherein said slit is located along said fold line.

6. The bag of claim 4, wherein said slit is located along said trim portion.

7. The bag of claim 4, wherein said slit is located along said second body panel.

8. The bag of claim 4, wherein said trim portion is adapted to be cut away and simultaneously a remaining portion of said second gusset panel is adapted to be attached to said second body panel to seal said fill opening.

9. A method of forming a bottom-fillable, bottom-gusseted bag, comprising:

supplying a sheet of material in a longitudinal direction;

folding said sheet to form a bag-forming structure including first and second opposing body panels and a bottom-gusset joining said first and second body panels, said bag-forming structure including an open end opposite said gusset, said gusset including first and second gusset panels foldably connected to each other and foldably connected to said respective first and second body panels;

slitting one of said second gusset panel and said second body panel along a transverse slit to provide a transverse fill opening through which a product can be inserted into said bag-forming structure; and applying a pair of transverse seals to said bag-forming structure to form an individual bag.

10. The method of claim 9, further comprising:

filling said bag by inserting said product through said fill opening; and attaching said second gusset panel to said second body panel to seal said fill opening.

11. The method of claim 9, further comprising the step of applying a zipper to said first and second body panels along said open end of said bag-forming structure.

12. The method of claim 11, wherein said zipper includes first and second tracks, said first track including a first profile and a first fin extending downward from said first profile, said second track including a second profile and a second fin extending downward from said second profile, said first and second profiles being releasably engageable to each other.

13. The method of claim 12, wherein said first and second fins are detachably connected to each other.

14. The method of claim 11, further including the step of slidably mounting a slider to said zipper for opening and closing said zipper.

15. The method of claim 9, wherein said folding step includes offsetting said bottom-gusset such that said second gusset panel extends beyond said first gusset panel to provide a protruding trim portion.

16. The method of claim 15, wherein said slitting step includes slitting said one of said second gusset panel and said second body panel proximate to a fold line foldably connecting said trim portion to said second body panel.

17. The method of claim 16, wherein said slit is located along said fold line.

18. The method of claim 16, wherein said slit is located along said trim portion.

19. The method of claim 16, wherein said slit is located along said second body panel.

20. The method of claim 15, wherein said attaching step includes the steps of cutting away said trim portion and simultaneously attaching a remaining portion of said second gusset panel to said second body panel to seal said fill opening.

21. A bottom-fillable, bottom-gusseted bag comprising:

a bag-forming structure including first and second opposing body panels joined along a pair of opposing transverse seals and a bottom-gusset extending between said transverse seals, said bag-forming structure including an open end opposite said bottom-gusset, said bottom-gusset including first and second gusset panels foldably connected to each other and foldably connected to said respective first and second body panels;

a zipper attached to said first and second body panels along said open end;

a slider slidably mounted to said zipper for opening and closing said zipper; and a transverse slit disposed proximate to a fold line foldably connecting said second gusset panel to said second body panel to provide a fill opening through which a product can be inserted into said bag-forming structure.

22. The bag of claim 21, wherein said zipper includes first and second tracks, said first track including a first profile and a first fin extending downward from said first profile, said second track including a second profile and a second fin extending downward from said second profile, said first and second profiles being releasably engageable to each other.

23. The bag of claim 22, wherein said first and second fins are detachably connected to each other.

24. The bag of claim 21, wherein said slit is located along said fold line.

25. The bag of claim 21, wherein said slit is located along said second gusset panel.

26. The bag of claim 21, wherein said slit is located along said second body panel.

27. The bag of claim 21, wherein a remaining portion of said second gusset panel is adapted to be attached to said second body panel to seal said fill opening.

28. A bottom-fillable, bottom-gusseted bag comprising:

a bag-forming structure including first and second opposing body panels joined along a pair of opposing transverse seals and a bottom-gusset extending between said transverse seals, said bag-forming structure including an open end opposite said bottom-gusset, said bottom-gusset including first and second gusset panels foldably connected to each other and foldably connected to said respective first and second body panels;

a zipper attached to said first and second body panels along said open end; and a transverse slit disposed proximate to a fold line foldably connecting said second gusset panel to said second body panel to provide a fill opening through which a product can be inserted into said bag-forming structure.

29. The bag of claim 28, further including a slider slidably mounted to said zipper for opening and closing said zipper.

30. The bag of claim 28, wherein said zipper includes first and second tracks, said first track including a first profile and a first fin extending downward from said first profile, said second track including a second profile and a second fin extending downward from said second profile, said first and second profiles being releasably engageable to each other.

31. The bag of claim 30, wherein said first and second fins are detachably connected to each other.

32. The bag of claim 28, wherein said slit is located along said fold line.

33. The bag of claim 28, wherein said slit is located along said second gusset panel.

34. The bag of claim 28, wherein said slit is located along said second body panel.

35. The bag of claim 28, wherein a remaining portion of said second gusset panel is adapted to be attached to said second body panel to seal said fill opening.

* * * * *